United States Patent [19]

Carternock et al.

[11] Patent Number: 4,679,337

[45] Date of Patent: Jul. 14, 1987

[54] MATERIAL WORKING MACHINE WITH VIBRATING TOOL CARRIER

[75] Inventors: Frederick A. Carternock, Seabrook Hythe; Jack S. Knackstedt, London, both of England

[73] Assignee: Jaromir Vaclav Drazil, Buckinghamshire, England

[21] Appl. No.: 761,110

[22] PCT Filed: Nov. 12, 1984

[86] PCT No.: PCT/GB84/00391

§ 371 Date: Jul. 29, 1985

§ 102(e) Date: Jul. 29, 1985

[87] PCT Pub. No.: WO85/02427

PCT Pub. Date: Jun. 6, 1985

[30] Foreign Application Priority Data

Nov. 29, 1983 [ZA] South Africa ..... 83/8903

[51] Int. Cl.[4] ..... E02F 3/42; E02F 3/84

[52] U.S. Cl. ..... 37/118 R; 37/DIG. 18; 172/40

[58] Field of Search ..... 37/DIG. 18, 118 R; 172/40; 173/49; 299/14

[56] References Cited

U.S. PATENT DOCUMENTS

| | | | |
|---|---|---|---|
| 2,986,294 | 5/1961 | Granryd | 37/DIG. 18 |
| 3,431,980 | 3/1969 | Singer, Jr. | 172/40 |
| 3,443,327 | 5/1969 | Martin | 172/40 X |
| 3,645,021 | 2/1972 | Sonerud | 37/141 R |
| 3,677,426 | 7/1972 | Luck | 37/DIG. 18 |
| 3,746,100 | 7/1973 | Hall et al. | 172/40 |
| 4,224,003 | 9/1980 | St. Louis | 404/133 |

FOREIGN PATENT DOCUMENTS

| | | | |
|---|---|---|---|
| 67018 | 12/1982 | European Pat. Off. | 37/DIG. 18 |
| 2165287 | 7/1973 | Fed. Rep. of Germany | 37/118 R |
| 1473271 | 2/1967 | France | 37/118 R |

*Primary Examiner*—Clifford D. Crowder

*Attorney, Agent, or Firm*—Diller, Ramik & Wight

[57] ABSTRACT

The machine comprises a vibrator (26) for applying vibratory forces, and a member (30) for applying non-vibratory forces to a vibratory tool carrier (52) to which is removably attached a working tool, e.g. a bucket (14). The vibrator includes an eccentric (50) and is driven by a drive (36–38). The tool carrier incorporates a first mounting (at 50) for its connection to the vibrator and a second mounting (34) for its connection to the member. The second mounting enables reciprocation of the tool carrier at the point of its attachment to the second mounting when the vibrator is in operation. The first and second mountings are spaced from each other in the direction of the reciprocation.

14 Claims, 13 Drawing Figures

FIG. 10
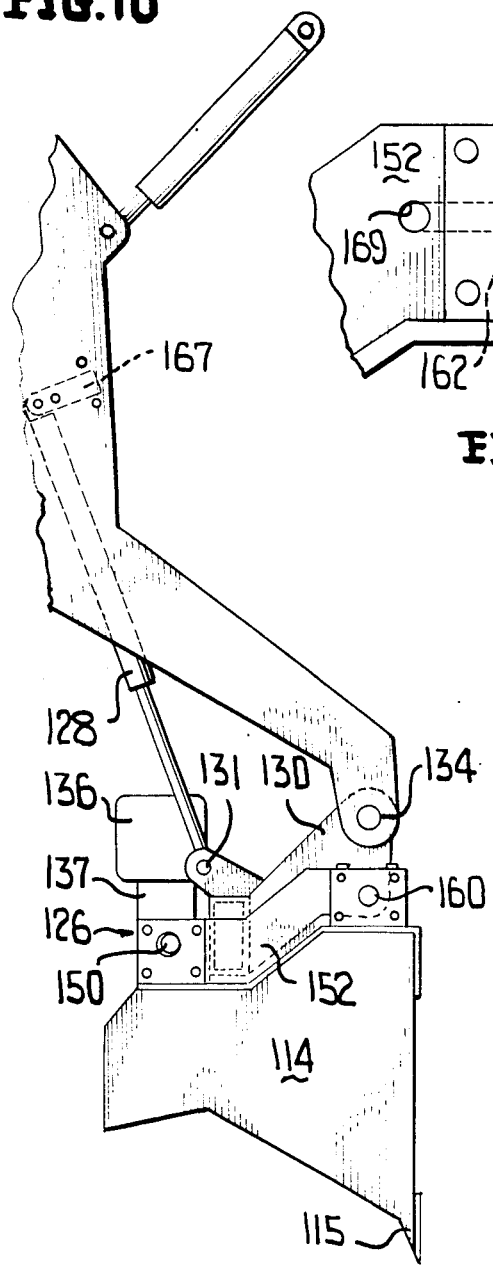
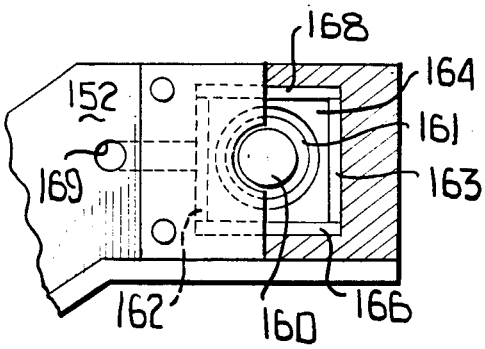
FIG. 12
FIG. 11
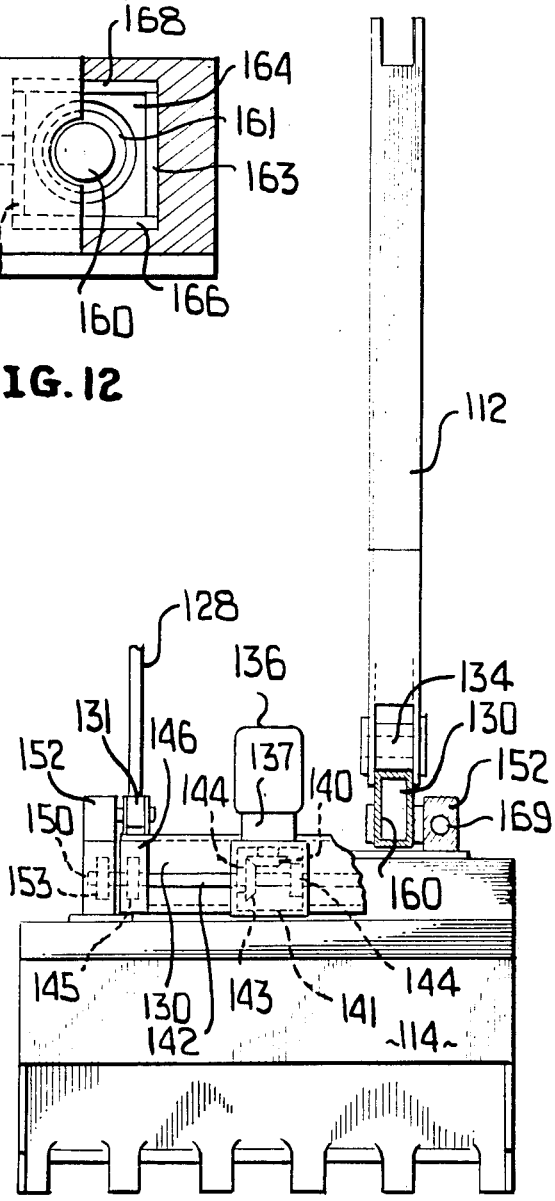

MATERIAL WORKING MACHINE WITH VIBRATING TOOL CARRIER

The invention relates to a material working machine, such as an excavator, loader, breaker, compactor, planer, paver or dredger, to which is, in operation, attached a working tool for working on or in a material, such as earth, while both vibratory and non-vibratory forces are applied thereto.

Known machines of this kind have various disadvantages. Replacement or substitution of a working tool on such a machine is laborious and time-consuming. Known machines are not designed, and consequently not suitable, for continuous working of the tool-carrying part of the machine under water, neither are they designed for universal use, and can therefore usually work with only one type of tool.

The aim of the present invention is to avoid, or at least to mitigate, these and other disadvantages of known machines.

This is achieved according to the invention by a material working machine comprising vibratory means, applying vibratory forces and driven by driving means, and non-vibratory means, applying non-vibratory forces, the machine having vibratory tool carrier means for removable attachment of a working tool, the tool carrier means incorporating first mounting means for its connection to the vibratory means, and second mounting means for its connection to the non-vibratory means, the second mounting means enabling reciprocationg of the tool carrier means at the point of it attachment to the second mounting means when the vibratory means is in operation, the first and second mounting means being spaced from each other in, or substantially in, the direction of said reciprocation.

In a preferred embodiment the driving means includes a motor sensing, via the vibratory means, load applied by the working tool to the tool carrier means at any instant of its operation and automatically responding by correspondingly adjusting its torque and, in inverse proportion thereto, its speed, which are then transmitted, via the vibratory means, as variable-torque vibratory forces to the tool carrier means which transmits them to the working tool.

In a further preferred embodiment, the tool carrier means incorporates at least one oil reservoir situated between the first and second mounting means for supplying oil to the first and second mounting means.

It is particularly advantageous to produce the tool carrier means by casting.

The advantages of a machine according to the invention include easy replacement and substitution of tools and also universality, i.e. the possibility to attach to the same tool carrier means divers tools.

Because the tool carrier means incorporates at least one oil reservoir, i.e. has a self-contained lubrication system, the machine can work with the whole tool carrier means under water, and the provision of the oil reservoir or reservoirs ensures good thermal stability for the bearings in the tool carrier means.

It has many further advantages to have a tool carrier means to which a tool is attached compared to the known machines without any tool carrier means, particularly if the tool carrier means is made by casting. Some of the advantages have already been mentioned, other include the possibility of precision machining and assembly of the tool carrier means in high volume production, the tool carrier means is attached to the machine and the single tool carrier means can be used for any tool, and all the tools used with the machine can be made without any tool attachment means of their own permanently fixed thereto, so that they are lighter and cheaper.

The invention will now be described, by way of example, with reference to the accompanying diagrammatic drawings, in which:

FIG. 10 is a side view of the relevant part of a material working machine including a front loader, which forms a further embodiment of the present invention;

FIG. 11 is a partial plan to FIG. 10;

FIG. 12 shows a combined rotary and sliding bearing used in the machine illustrated in FIGS. 10 and 11.

Figure 1:
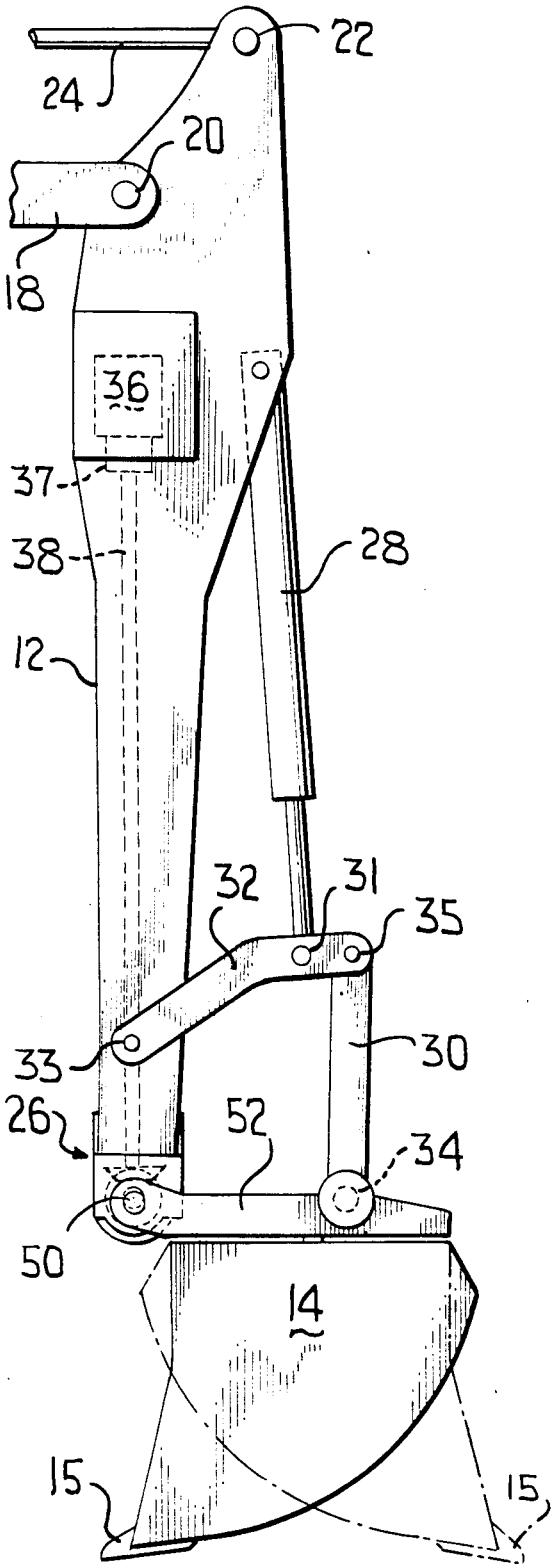
FIG. 1 is a side view of a relevant part of a material working machine according to the invention provided with a bucket.
Figure 2:
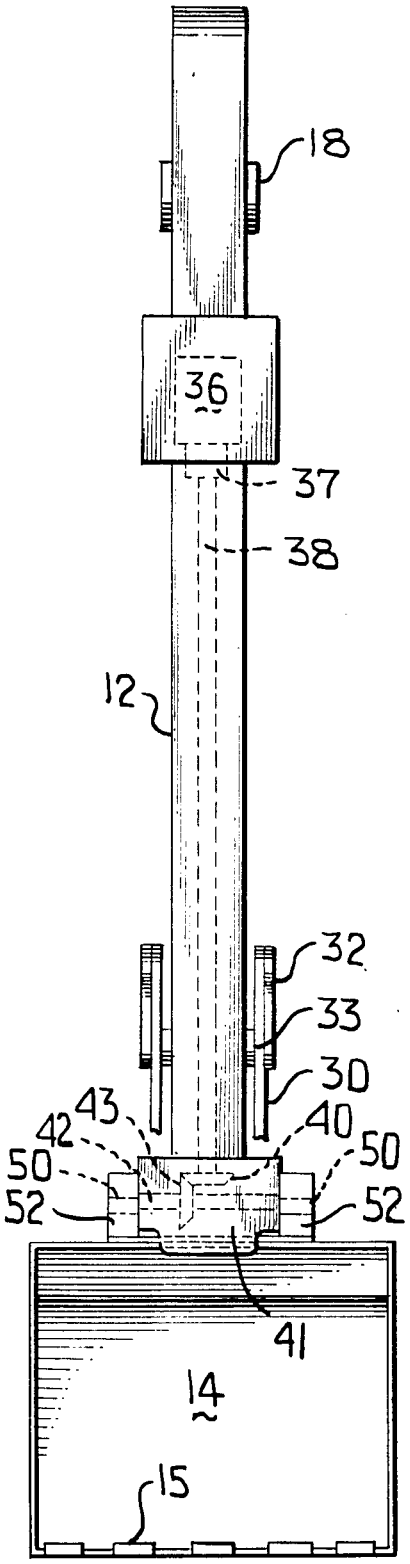
FIG. 2 is a front view to FIG. 1.
Figure 3:
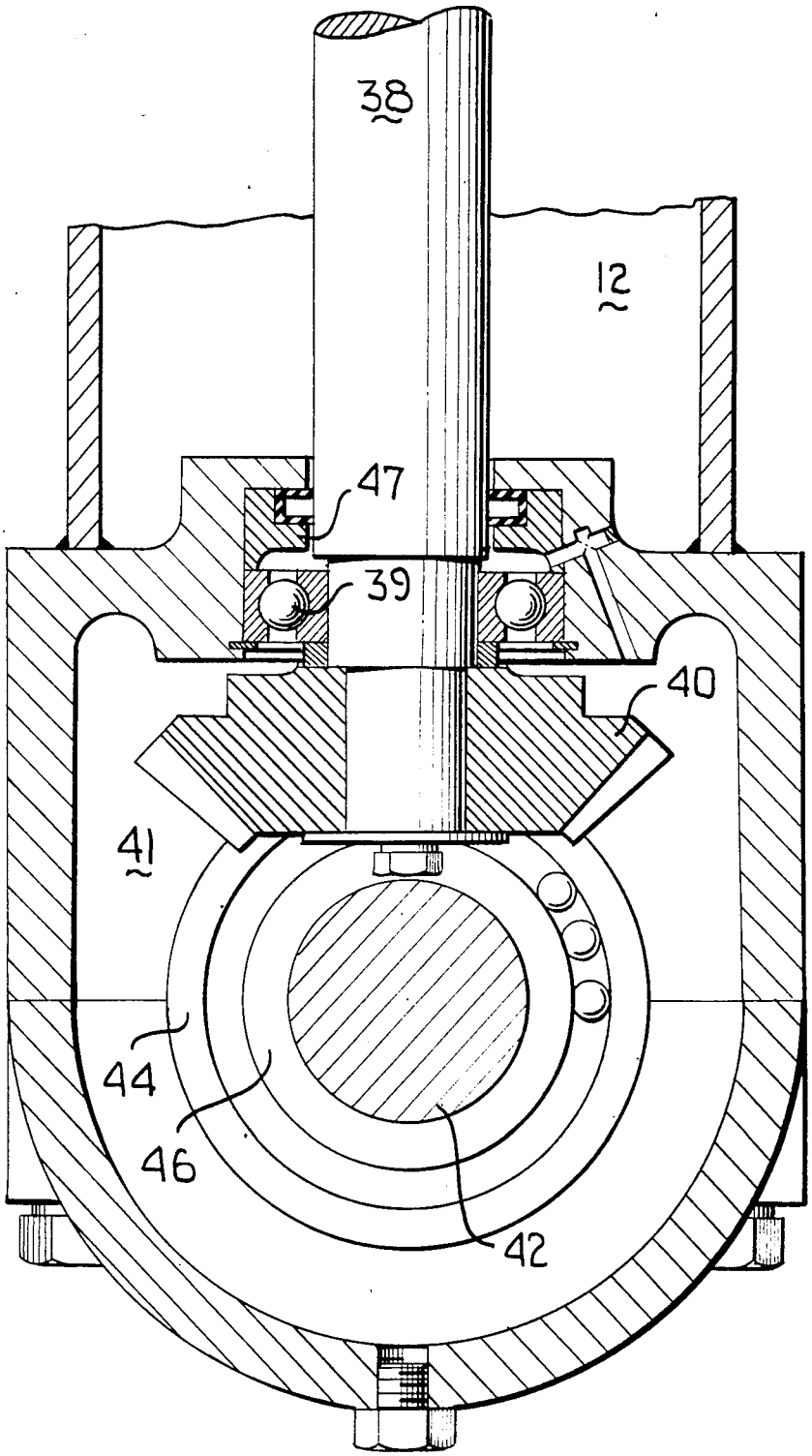
FIG. 3 is a section of the drive shown in FIGS. 1 and 2.
Figure 4:
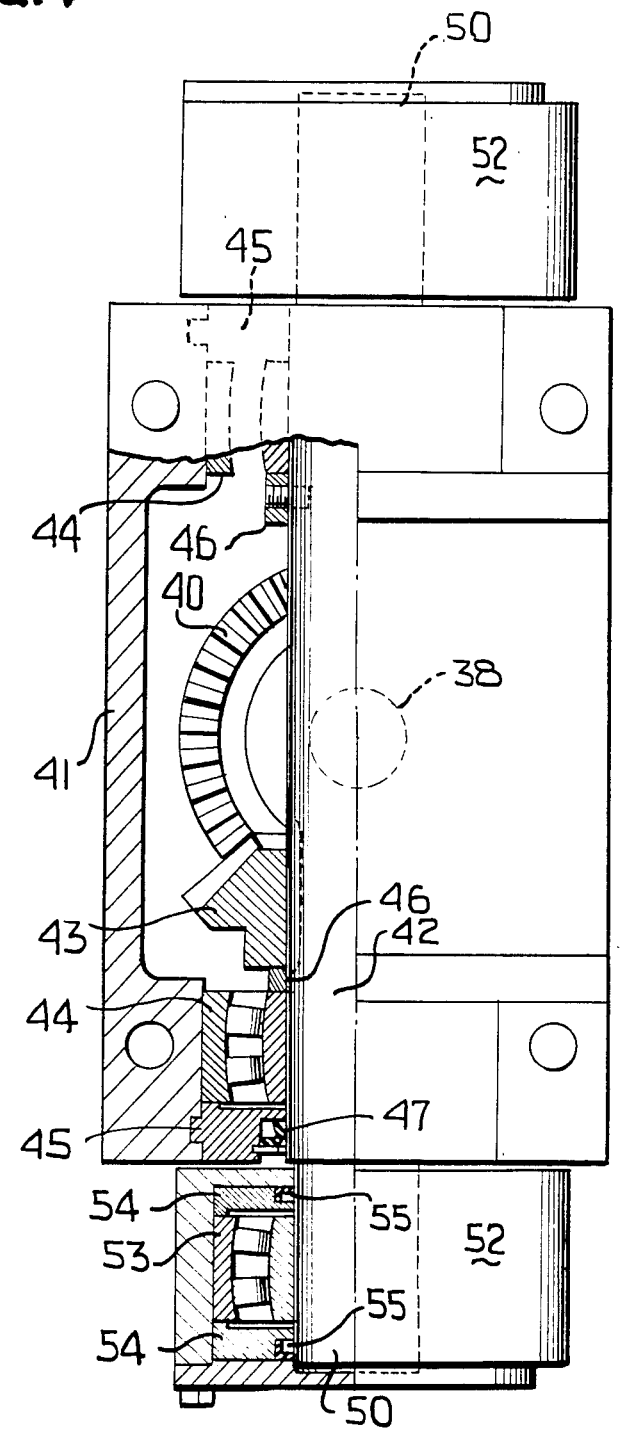
FIG. 4 is a front view, partly in section, of the drive shown in FIGS. 1, 2 and 3.
Figure 5:
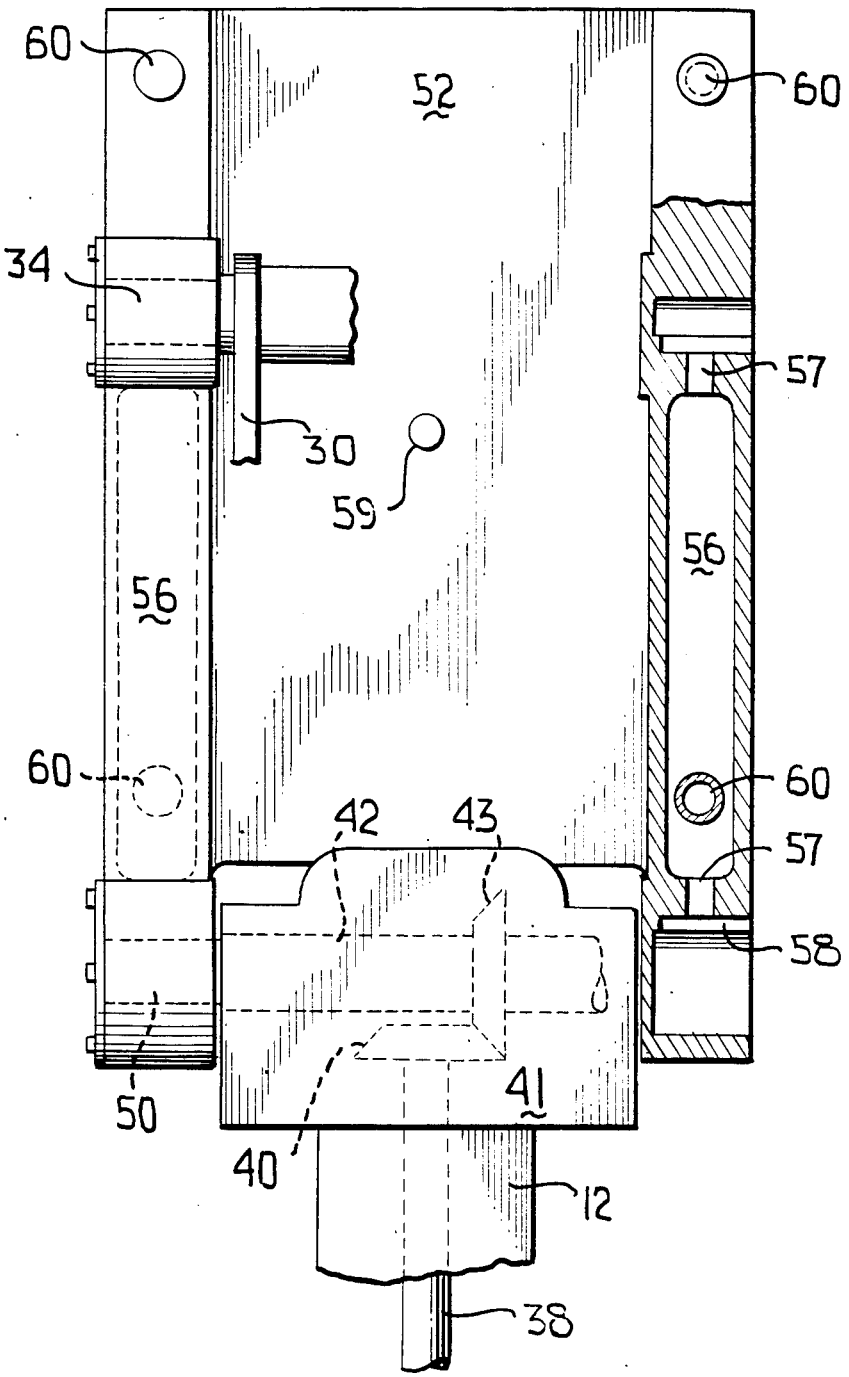
FIG. 5 is a plan, partly in section, of a tool carrier shown in FIGS. 1 and 2.

FIGS. 1 and 2 show an implement arm 12 of an excavator. The arm 12 carries a vibratory tool carrier 52 to which is firmly fixed a bucket 14 provided with teeth 15. The arm 12 is pivotally connected to a dipper arm 18 about a pivot 20 and to a dipper ram 24 about a pivot 22. The dipper ram 24 is operable to lift and lower the implement arm 12.

A vibratory mechanism, indicated generally at 26, is mounted on the implement arm 12. An implement ram 28, operable to impose arcuate movement to the tool carrier 52, is connected at a pivot 31 to pivotal links 32. The links 32 are pivotally connected at pivots 33 to the implement arm 12. Pivotal links 30, connected to the vibratory tool carrier 52 at a pivot 34, are connected to links 32 at a pivot 35. The links 30 and 32 are operable by the implement ram 28 to control the position of the tool carrier 52 relative to the implement arm 12 while permitting it to vibrate, as links 30 swing to and fro about the pivot 35.

Referring now to FIGS. 1 to 5, the vibratory mechanism 26 comprises a hydraulic motor 36 to which is connected by its upper end a shaft 38 mounted in bearings 37 and 39. The lower end of the shaft 38 carries a first bevel gear 40 situated in a first housing 41 partially filled with oil. Transversely through the first housing 41 passes a transverse shaft 42 carrying a second bevel gear 43 meshing with the first bevel gear 40. The transverse shaft 42 is mounted in bearings 44 each of which is situated between an outer retaining collar 45 and an inner retaining collar 46. Both the shafts 38 and 42 pass through seals 47 in the first housing 41 to prevent oil from escaping from the first housing 41. Both ends of the shaft 42 extend laterally from the first housing 41.

At each end of the shaft 42 is an eccentric 50. Both eccentrics 50 are sealed in the vibratory tool carrier 52. The illustrated tool carrier 52 is made as a single sturdy casting which comprises for each eccentric 50 a bearing 53, situated between two retaining collars 54 provided with seals 55. For large working tools the tool carrier 52 may be formed by two or more castings bolted together. Spaced from the bearings 53 are bearings (not shown) for the pivot 34. The tool carrier 52 has two lateral oil reservoirs 56, each situated between one of the bearings 53 and one of the bearings for the pivot 34, from which oil is fed to these bearings through passageways 57 and 58.

The bucket 14 is firmly fixed to the tool carrier 52 by a retaining pin 59 and four fixing members 60. When the fixing members 60 are removed, the bucket 14 can be swivelled on the retaining pin 59, e.g. through 180° as shown in dashed lines in FIG. 1, and again firmly fixed to the tool carrier 52, whereby the machine is converted from a back hoe to a front loader.

The hydraulic motor 36 drives the shaft 38 and this rotation is transmitted, via the bevel gears 40 and 43, to the transverse shaft 42 causing the eccentrics 50 to describe a circular orbit (having a radius of less than 1 cm, for example about 1 mm) around the axis of the shaft 42 thereby vibrating the tool carrier 52 in a manner which is controlled by the links 30 connected via the links 32 to the ram 28. With this arrangement, the eccentrics 50 cause the teeth 15 on the bucket 14 to describe a close curve of a generally elliptical shape during each cycle of vibration.

Figure 6:
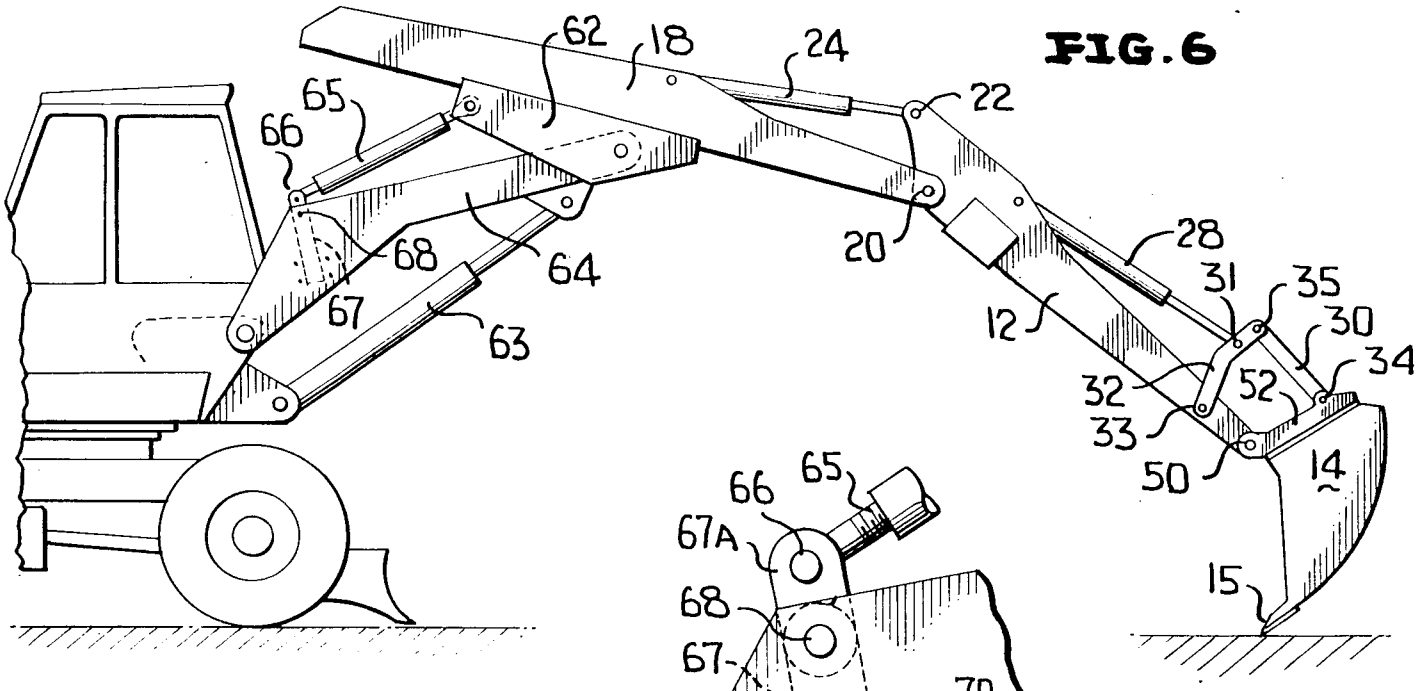
FIG. 6 is a side view of a material working machine according to the invention.

FIG. 6 shows a machine having an implement arm 12, as described in connection with FIGS. 1 and 2, connected to a dipper arm 18 and dipper ram 24, which in turn is slidably carried in a boom slide 62. The boom slide 62 is pivotally connected to a boom arm 64, displaceable by a boom ram 63, and to a first end of a turnbuckle 65 which actuates automatic start-stop means shown in greater detail in FIG. 7. This means includes a lever 67 hinged by a pivot 68 in the boom arm 64. The second end of the turnbuckle 65 is by a pivot 66 connected to a short arm 67A of the lever 67. The long arm 67B of the lever 67 extends between two stops 69 and two microswitches 70.

The movement of the long arm 67B is controlled by control means 71 which, in the illustrated example, comprises two opposed pairs of compression springs 72, each situated between a central movable abutment 73 fixed to the long arm 67B and a stationary abutment 74 fixed to the boom arm 64. It will be understood that other elements than compression springs can be used to control the preselected actuation pressure. The force of the springs 72 is adjustable. Any forces acting on the arms 12,18,64 are transmitted, via the turnbuckle 65, to the lever 67 and try to deflect its long arm 67B towards one of the microswitches 70, but the long arm 67B can actuate the relevant microswitch 70 only if these forces are so high that they overcome the control means 71. The function of the microswitches 70 will be described later in connection with FIG. 13.

Figure 8:
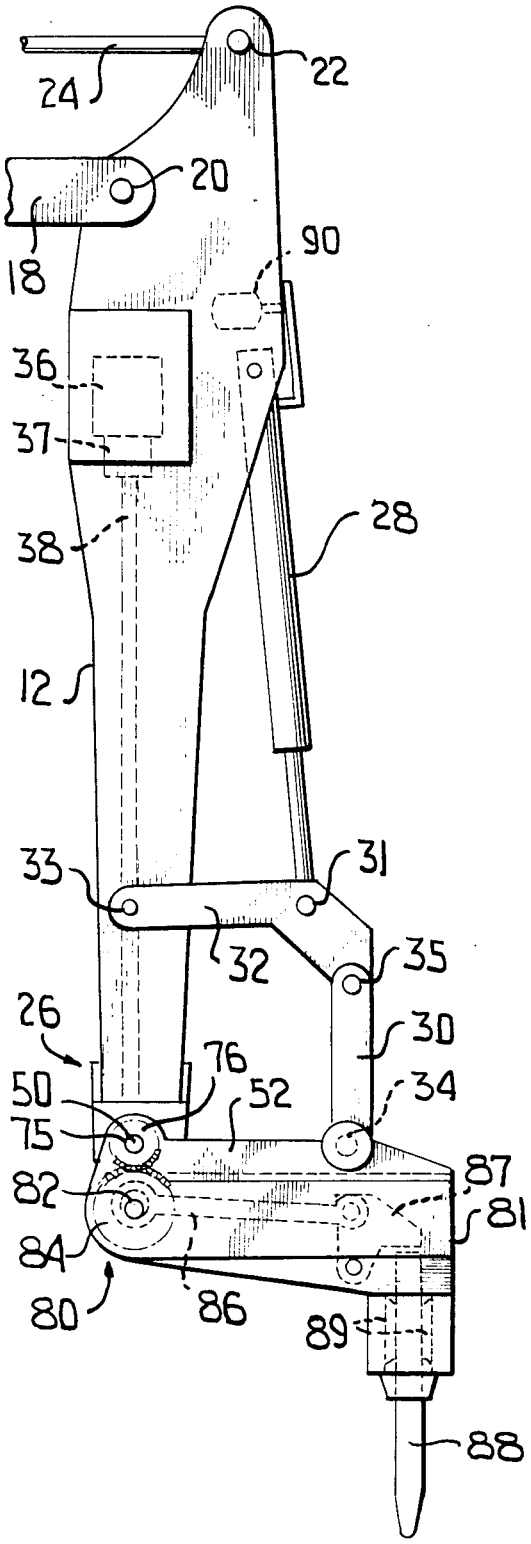
FIG. 8 is a side view of a further embodiment of a machine according to the invention provided with a breaker.
Figure 9:
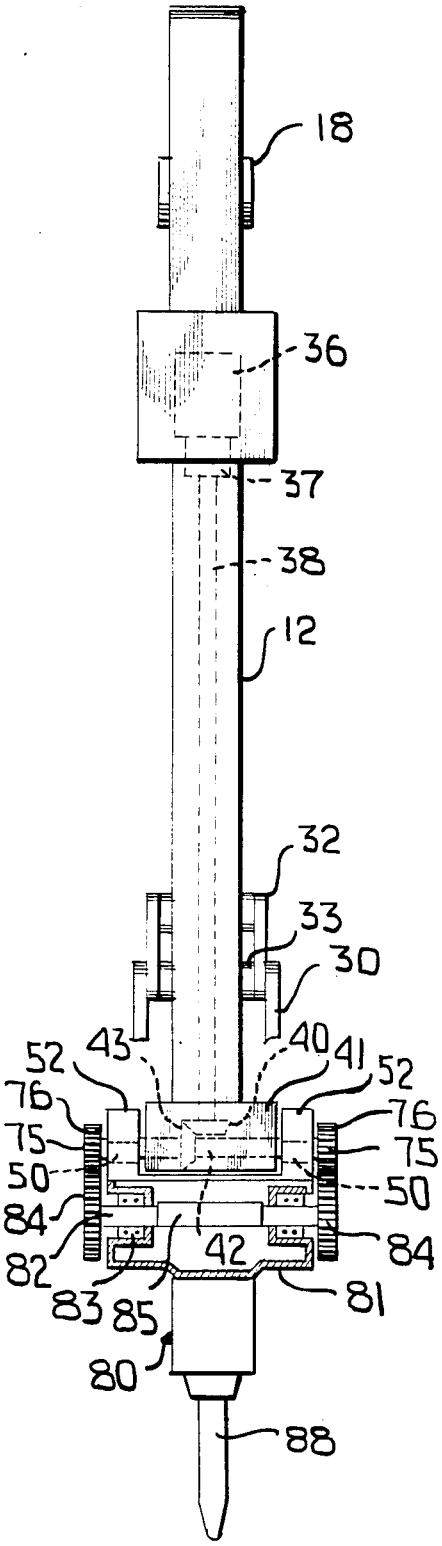
FIG. 9 is a front view to FIG. 8.

FIGS. 8 and 9 show an embodiment having elements 12 to 52 substantially identical with those described in connection with FIGS. 1 and 2. The shaft 42 has at each end a non-eccentric stub 75 carrying a spur wheel 76. In an alternative arrangement (not shown) other driving elements may be used instead of the stub 75 and wheel 76, for instance a further eccentric or crank.

To the tool carrier 52 is attached, e.g. by bolts or quick-release couplings, a breaker unit 80 comprising a housing 81 which forms an oil sump and through which extends a shaft 82 mounted in bearings 83. The shaft 82 carries at each end a spur wheel 84 meshing with the adjacent spur wheel 76 of the tool carrier 52. The centre of the shaft 82 is formed into an eccentric 85 coupled with a rod 86 pivotally connected to a rocker arm 87 which converts the rotary motion of the shaft 82 into a reciprocating motion imparted to a working tool 88 (here a spike) guided in slides 89. The wheels 76 and 84 on each side of the tool carrier 52 and housing 81 are protected by a common sealed cover (not shown). The oil from the sump in the housing 81 lubricates both the bearings 83 and the wheels 76 and 84.

Other working tool units may be attached to the tool carrier 52, in which the tool may be driven by a drive independent on the drive for the eccentrics 50.

In operation the rocker arm 87 causes the working tool 88 to perform a rectilinear reciprocating motion on which is superimposed the motion of the tool carrier 52 generated by the eccentrics 50 of the vibratory mechanism 26. The amplitude (length) of the rectilinear reciprocating motion of the tool 88 is greater than the amplitude (throw) of the eccentrics 50, the ratio of the said amplitudes being 10:1 in the illustrated example.

As is apparent from the drawing, the spur wheels 76 and 84 are of a different diameter so that the frequencies of the two superimposed motions are different. As a consequence of this arrangement, the working tool 88 operates without seizure.

The oscillatory forces generated by the eccentrics 50 and the eccentric 85 increase and decrease in direct proportion to each other.

To protect the machine from shocks when the tool 88 impinges on a very hard material, e.g. when breaking concrete or rock, a shock absorber 90 is connected to the hydraulic system of the implement ram 28. A suitable shock absorber comprises a pressure vessel containing hydraulic liquid of the system and also containing an inflatable bag which is filled with gas and is consequently compressible. The gas pressure in the bag is set to be higher than the maximum pressure for operating the implement ram 28. A shock absorber may also be used in the hydraulic system of the other described embodiments.

FIGS. 10 and 11 show a front loader mechanism of a material working machine which comprises a front loader bucket 114 provided with teeth 115 and attached to two vibratory tool carriers 152. The front loader mechanism includes an arm 112 to which is pivotally connected by pivots 134 a substantially U-shaped link member 130 which is in turn pivotally connected to rams 128 by pivots 131, the rams 128 being operable to effect movement of the link member 130 about the pivots 134 relative to the arm 112. The machine comprises a vibratory mechanism, indicated generally at 126 which, when driven by a hydraulic motor 136, imparts vibratory motion to two vibratory tool carriers 152, and thereby to the tool (here bucket 114) attached thereto.

The vibratory mechanism 126 comprises said motor 136 to which is connected a shaft (not shown) mounted in bearings 137 and carrying a first bevel gear 140 situated in a first sealed housing 141 partially filled with oil. Transversely through the first housing 141 passes a transverse shaft 142 carrying a second bevel gear 143 meshing with the first bevel gear 140. The transverse shaft 142 is mounted in first bearings 144 situated in the first housing 141, and in second bearings 145, each of which is contained in a separate second sealed housing 146 which is fixed to the top of the link member 130, to which also the first housing 141 is fixed.

At each end of the shaft 142 is an eccentric 150. Each eccentric 150 is mounted in a bearing 153, and both the eccentric 150 and the bearing 153 are sealed in one of the tool carriers 152. Both the housings 146 and the tool carriers 152 have a respective separate oil reservoir (not shown). The bucket 114 is connected to the two tool carriers 152. The bucket 114 is therefore via the two tool carriers 152, bearings 153, eccentrics 150, shaft 142, bearings 145 and housings 146 pivotally connected to the top of the link member 130.

The bottom of the link member 130 is pivotally attached to the bottoms of the two tool carriers 152 by means of pivots 160. As is apparent from FIG. 12, each pivot 160 is rotatably mounted by means of a bearing 161 in a bearing block 164 which is slidably retained between rigid plates 166 and 168 so that it can slide up and down in the two tool carriers 152. Spaces 162,163 are provided for this motion in the two tool carriers 152 and this enables the two tool carriers 152 to perform the desired motion. There is an oil duct 169 in each of the tool carriers 152 to facilitate lubrication of the bearing 161 and of the bearing block 164. The end of each ram 128 remote from the pivots 131 is pivotally connected to a lever 167 of an automatic start-stop means described in connection with FIG. 7.

The resultant movement of the bucket teeth 115 is an elongate, very slim figure of eight having its major dimension almost perpendicular to the direction in which the teeth 115 of the bucket 114 extend forwardly, which is substantially the same as the direction in which the bucket 114 is pushed by translatory tractive movement into the material to be loaded. The loosening effect of this vibration upon the material results in that smaller tractive force is needed to drive a given bucket into a given type of material.

Figure 13:
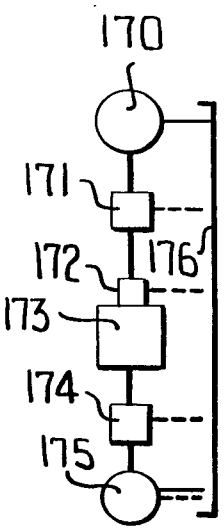
FIG. 13 shows the hydraulic circuit of the vibration mechanism.

FIG. 13 shows a hydraulic circuit of the vibratory mechanism. The circuit comprises a pump 170, relief valve 171, a shock absorber 172, a solenoid valve 173, a priority flow control valve 174 and a motor 175 (such as the motor 36 in FIGS. 1 and 2 or FIGS. 8 and 9, or the motor 136 in FIGS. 10 and 11). The shock absorber 172 serves to protect the hydraulic system from a so-called hydraulic line shock and may be a pressure vessel containing together with hydraulic liquid of the system also an inflatable bag which is filled with gas and is consequently compressible.

The oil in the hydraulic system is constantly pumped by the pump 170. When none of the microswitches 70 (FIG. 7) is actuated the oil is pumped by the pump 170 to the relief valve 171 to the valve 173 from which it flows back to the tank 176 of the system. When one of the microswitches 70 is actuated it causes the solenoid valve 173 to direct the flow through the valve 174 to the motor 175 which is thus operated and drives the vibratory mechanism.

Figure 7:
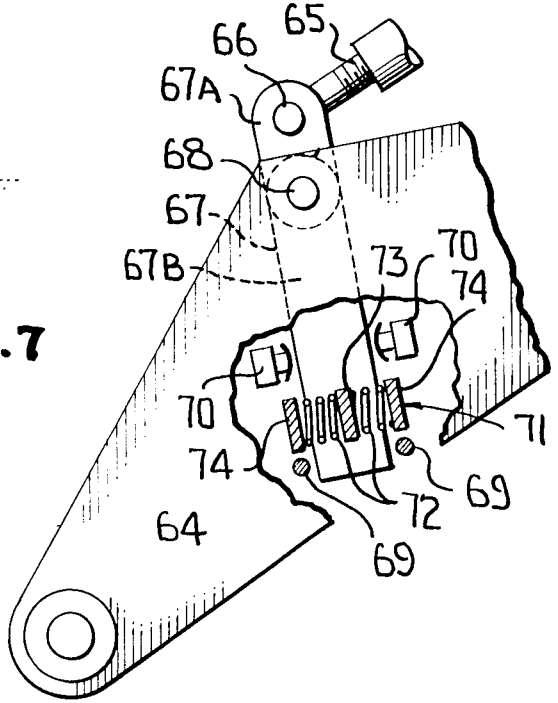
FIG. 7 shows a detail from FIG. 6.

As will be apparent from the description, the system of FIG. 7 automatically controls the system of FIG. 13, the two systems forming an automatic start-stop control device of the vibratory mechanism. This device can have a manual override controlled by the operator from the cab.

The hydraulic circuit for the vibratory mechanism is provided with a flow transducer (not shown) which sends signals representative of the volume flow rate through the flow transducer, to a torque monitor (not shown) calibrated in units of torque, whereby information about instantaneous torque of the hydraulic motor 36 or 136 (motor 175 in FIG. 13) is provided.

The hydraulic motor 36 or 136 is a pressure compensated motor of a type obtainable from RHL Hydraulics of Planet Place, Killingworth, Newcastle-upon-Tyne, England, in which, as the output torque rises, the output speed (rotational frequency) falls, thus giving substantially constant power output.

In all the embodiments described above, the eccentrics may be driven by any appropriate means, for example, an electric motor with a constant power output, instead of a hydraulic motor, in which case an electric circuit will be substituted for the hydraulic circuit.

Many variations are possible. The motor may drive the transverse shaft 42,142 directly. Other types of implement than a bucket or a breaker unit e.g. a spike, an impact drill, a chisel, a screed, a blade, a clam shell or a compacting implement with a flat base or a roller, may be attached to the same tool carrier 52,152 as has been described.

Pneumatic rams may be used instead of the hydraulic rams described.

The tool carrier 52,152 may be made of two main parts one of which is rotatable, displaceable and/or adjustable relative to the other.

In each case, but on a lesser scale, the invention may also be applied to machines which are manually manoeuvred instead of mounted on a "prime mover".

It will be apparent from FIGS. 1 and 2 that because the eccentrics 50 are nearer to the pivot 34 than are the teeth 15, the amplitude of the vibration at the teeth 15 is greater than that of the vibration of the eccentrics 50. The same applies, mutatis mutandis, to FIGS. 8, 9 and 10, 11.

The vibratory forces are greater than the non-vibratory forces. It will be apparent from FIGS. 1, 2, 6, 8 and 9 that major part of the nonvibratory (translatory) forces is applied along a path 28,31,32,35,30,34 which differs from the path 50 along which are applied the vibratory forces, but that these two paths converge at the teeth 15 of the bucket 14 (FIGS. 1, 2, 6) or the tip of the spike 88 (FIGS. 8, 9). In the embodiment shown in FIGS. 10, 11 major part of the non-vibratory (tractive) forces proceeds along a path 112,134,160 which differs from the path 150 along which are applied the vibratory forces, and these two paths converge at the teeth 115. In all the embodiments (FIGS. 1, 2, 6, 8, 9, 10, 11) not only the two force paths are separate and independent but also the operating hydraulic circuits for these forces are separate and independent.

In the embodiments shown in FIGS. 1, 2 and 6 a sliding bearing, such as that illustrated in FIG. 12, can be used for the pivot 34. It will be understood that the bearing of FIG. 12 will be so positioned that it will slide in, or substantially in, the direction towards and away from the eccentrics 50.

Instead of the pivot 160 shown in FIGS. 10 and 11, mounted by means of the bearing shown in FIG. 12, an arrangement similar to the arrangement including the link 30 and the pivots 35 and 34 may be used in the embodiment according to FIGS. 10 and 11.

In the claims the term "vibratory means" is intended to mean "means applying vibratory forces" and the term "non-vibratory means" is intended to mean "means for applying non-vibratory forces".

We claim:

1. A material working machine comprising vibratory means driven by driving means, and non-vibratory means, and including vibratory tool carrier means including attachment means for removable attachment, to the tool carrier means, of a working tool or working tool unit, the tool carrier means incorporating first mounting means for its connection to the vibratory means, and second mounting means for its connection to the non-vibratory means, the second mounting means enabling reciprocation of the tool carrier means at the point of its attachment to the second mounting means when the vibratory means is in operation, the first and second mounting means being spaced from each other in, or substantially in, the direction of said reciprocation, and said tool carrier means incorporates at least one oil reservoir means fluidically connected between the first and second mounting means for supplying oil to both said first and second mounting means.

2. A machine according to claim 1 wherein the driving means includes a constant power motor which automatically responds to any motor variation in, the load applied by the working tool at any instant of its operation.

3. A machine according to claim 1 wherein the second mounting means is a swingably suspended pivotal connection.

4. A machine according to Claim 1, wherein the second mounting means is a pivotal connection in a slidably mounted bearing.

5. A machine according to claim 1 wherein the tool carrier means is made by casting.

6. A machine according to claim 1 wherein the nonvibratory means includes a hydraulically operated ram, a shock absorber being connected to the hydraulic system of the ram.

7. A machine according to claim 1 wherein the working tool unit includes a housing which forms an oil sump.

8. A machine according to claim 1 wherein the machine is so designed that the vibratory forces are applied to the tool carrier means along a path which differs from the path along which is applied a major part of the non-vibratory forces.

9. A material working machine comprising vibratory means driven by driving means, and non-vibratory means, and including vibratory tool carrier means including attachment means for removable attachment, to the tool carrier means, of a working tool or working tool unit, the tool carrier means incorporating first mounting means for its connection to the vibratory means, and second mounting means for its connection to the non-vibratory means, the second mounting means enabling reciprocation of the tool carrier means at the point of its attachment to the second mounting means when the vibratory means is in operation, the first and second mounting means being spaced from each other in, or substantially in, the direction of said reciprocation, the driving means includes a hydraulic motor incorporated in a separate hydraulic system independent of any other hydraulic system the machine may have, the machine including an automatic start-stop device actuated by the non-vibratory reaction forces due to the non-vibratory means to start and stop the vibratory means when said non-vibratory reaction forces reach a predetermined value, the hydraulic system includes a valve which in a first position directs flow of oil to the hydraulic motor and in a second position prevents the oil from reaching the hydraulic motor, the valve being remotely controlled by control means which in turn is actuated by mechanical means responsive to said non-vibratory reaction forces.

10. A machine according to claim 9 wherein the control means incorporates an electric circuit.

11. A material working machine comprising vibratory means driven by driving means, and non-vibratory means, both the vibratory and non-vibratory means serving to act, in operation, on a working tool or working tool unit, the machine including an automatic start-stop device actuated by the non-vibratory reaction forces due to the non-vibratory means to start and stop the vibratory means when said non-vibratory reaction forces reach a predetermined value, said driving means includes a hydraulic motor incorporated in a separate hydraulic system independent of any other hydraulic system the machine may have, and wherein the hydraulic system includes a valve which in a first position directs flow of oil to the hydraulic motor and in a second position prevents oil from reaching the hydraulic motor, the valve being remotely controlled by control means which in turn is actuated by mechanical means responsive to said non-vibratory reaction forces.

12. A machine according to claim 11 wherein the control means incorporates an electric circuit.

13. A machine according to claim 12 wherein the hydraulic system is provided with a flow transducer which sends symbols, representative of the volume flow rate therethrough to a torque monitor calibrated in units of torque.

14. A machine according to claim 11 wherein the hydraulic system is provided with a flow transducer which sends signals, representative of the volume flow rate therethrough, to a torque monitor calibrated in units of torque.

* * * * *